United States Patent [19]

Miles et al.

[11] 4,104,423

[45] Aug. 1, 1978

[54] CORROSION INHIBITORS

[75] Inventors: Peter Miles, Stockport; James Roger Hargreaves, Sale; John Burrows, Congleton, all of England

[73] Assignee: Ciba-Geigy Corporation, Ardsley, N.Y.

[21] Appl. No.: 768,244

[22] Filed: Feb. 14, 1977

[30] Foreign Application Priority Data

Feb. 21, 1976 [GB] United Kingdom ..... 6935/76

[51] Int. Cl.[2] ..... C07C 143/14; C07C 143/10; B32B 15/18; B05D 1/18

[52] U.S. Cl. ..... 427/402; 148/31.5; 260/465 D; 260/465 E; 260/501.19; 260/501.21; 260/507 R; 260/508; 427/406; 427/421; 427/429; 427/435; 428/457; 428/624

[58] Field of Search ..... 428/457, 624; 148/6.24, 148/31.5; 427/406, 421, 402, 429, 435; 260/501.19, 501.21, 507 R, 508, 465 D, 465 E

[56] References Cited

U.S. PATENT DOCUMENTS 2,600,287 6/1952 Wicklatz ..... 260/501.21

*Primary Examiner*—James R. Hoffman

*Attorney, Agent, or Firm*—Luther A. R. Hall

[57] ABSTRACT

Addition compounds of sulfur dioxide and Schiff bases from primary aliphatic or araliphatic amines and aromatic aldehydes can be used for the sealing of the surface of phosphated mild steel. As a result of this the corrosion resistance of the steel and the adhesion of paint coatings on the treated steel are increased substantially. The addition compounds may have three different structures depending on the components used. They can be prepared easily by passing a stream of $SO_2$ through the solution of the Schiff base.

10 Claims, No Drawings

CORROSION INHIBITORS

The present invention relates to novel compounds which may be prepared by reacting aliphatic primary amines with aromatic aldehydes and sulphur dioxide or compounds which are sulphur dioxide precursors, and their use as film sealers for protection of phosphated steel against corrosion.

A product derived from the addition of sulphur dioxide to the condensation product of benzaldehyde and aniline was first described by H. Schiff (Annalen 140, 125, 129, 210 [1866]). Later, E. Knoevenagel (Berichte, 37, 4087, [1904]) correctly assigned the formula $C_6H_5—CH(NHC_6H_5)—SO_3H.C_6H_5NH_2$ to account for the elemental analysis of the isolated compound.

Further work on other free acid derivatives was abandoned in favour of the more stable sodium salts. These salts were prepared by adding sodium bisulphite to the corresponding Schiff base (A. von Eibner, Annalen, 316, 89 [1901]). Recently a more detailed study of the sodium salts was conducted by L. Neelakantan and W. H. Hartung (J. Org. Chem. 1943, 24 [1959]), but no attempt was made to isolate the corresponding acids.

Whereas adducts of aromatic Schiff's bases as well as the well-known sodium bisulfite addition products of aromatic aldehydes are inactive as film sealers for phosphated steels, we have found, surprisingly, that compounds prepared from aliphatic or cycloaliphatic amines instead of aromatic amines are significantly active. The well known sodium bisulphite addition products of aromatic aldehydes are likewise inactive.

Accordingly the present invention provides a compound having the general formula

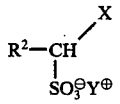

I wherein X is OH or $NHR^1$, Y is hydrogen or $NH_3R^1$, with the proviso that when X is OH Y cannot be hydrogen, $R^1$ is a saturated or unsaturated aliphatic or cycloaliphatic hydrocarbon radical containing from 1 to 20 carbon atoms optionally substituted by one or more halogen, cyano, nitro, hydroxyl, carboxyalkyl or sulphoxyalkyl radicals in which the alkyl group contains from 1 to 4 carbon atoms, and $R^2$ is an aryl, alkaryl or aralkyl radical containing from 6 to 20 carbon atoms which may be optionally substituted by one or more cyano, nitro, halogen, hydroxyl, carboxyl, carboxyalkyl in which the alkyl group contains 1 to 4 carbon atoms, hydroxymethyl or methoxymethyl radicals or mixtures thereof.

Within the general formula I, three different classes of products may be obtained depending upon the amine used and to a lesser extent upon the aldehyde used in their preparation. The three different classes of compounds may be represented by the following general formulae II, III and IV.

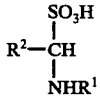

II

-continued

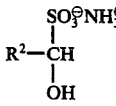

III

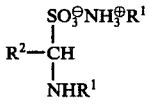

IV wherein $R^1$ and $R^2$ have their previous designation.

In the compounds of the invention when $R^1$ is a saturated aliphatic hydrocarbon radical it preferably contains 1 to 10 and especially from 1 to 4 carbon atoms: when $R^1$ is an unsaturated aliphatic radical it may contain from 3 to 20 carbon atoms, and preferably 3 to 12 carbon atoms: when $R^1$ is saturated or unsaturated cycloaliphatic it may contain from 5 to 12 carbon atoms, preferably 6. $R^2$ preferably contains from 6 to 10 carbon atoms and most preferably is a phenyl residue.

When $R^1$ is a saturated aliphatic radical it may be for example, methyl, ethyl, propyl, isopropyl, n-butyl, isobutyl, sec-butyl, amyl, hexyl, heptyl, octyl, nonyl, decyl, dodecyl, tetradecyl, octadecyl or eicosyl optionally substituted as hereinbefore defined, or mixtures thereof.

When $R^1$ is an unsaturated aliphatic radical it may be for example, allyl, butenyl, hexenyl, octenyl, decenyl, dodecenyl or oleyl optionally substituted as hereinbefore defined, or mixtures thereof.

When $R^1$ is a saturated or unsaturated cycloaliphatic radical it may be for example, cyclopentyl, cyclohexyl, cyclooctyl, cyclodecyl, cyclododecyl, cyclohexenyl, cyclodecenyl or cyclododecenyl optionally substituted as hereinbefore defined, or mixtures thereof.

$R^2$ may be for example, phenyl, phenylmethyl, tolyl, o- or p-hydroxyphenyl, p-nitrophenyl, p-chlorophenyl, naphthyl, p-t-butylphenyl, p-t-octylphenyl, p-nonylphenyl or p-dodecylphenyl or mixtures thereof.

Most preferably $R^1$ is methyl, ethyl or isopropyl and $R^2$ is phenyl.

The compound of formula I may be prepared by reacting with sulphur dioxide, or a sulphur dioxide precursor, a solution of a Schiff's base having the formula $R^1—N=CH—R^2$ wherein $R^1$ and $R^2$ have their previous designation.

The Schiff's base is advantageously dissolved in an inert water miscible solvent to which is added an equimolar proportion of water and conveniently the stirred solution is saturated with sulphur dioxide. The inert water-miscible solvent may be methanol, ethanol, n-propanol, iso-propanol or dioxan.

This method of preparing the compound of formula I may be modified as follows:

a. The aldehyde $R^2CHO$ is dissolved in ethanol and the amine $R^1NH_2$ added dropwise. After standing, a stream of sulphur dioxide is passed through the solution whereupon the precipitated product is obtained by filtration.

b. A solution or suspension in water of the amine $R^1NH_2$ is saturated with sulphur dioxide and an equimolar proportion of an aldehyde $R^2CHO$ is added and the resulting precipitate filtered.

In all methods of preparation, the product may be filtered off and recrystallised, conveniently from an aliphatic alcohol such as ethanol. However, in some cases the product may be very soluble in the medium and may only be recovered by removing the solvent prior to recrystallisation.

The compounds of the present invention are valuable film sealers when used in the treatment of phosphated steel to improve the corrosion resistance and provide a strong bonding for paints.

Chromates are widely used as phosphate sealers and reduce paint film blistering on phosphated mild steel. However, large volumes of rinse water contaminated with hexavalent chromium ions are generated by the process and since chromate ions are toxic and pollute any stream or river into which water containing them is discharged, they are ecologically undesirable.

We have found that the compounds of the present invention can be used instead of the chromates and do not present the environmental disadvantages of the chromates.

The present invention also provides a method of treating phosphated mild steel or zinc coated mild steel which comprises contacting the mild steel with a solution containing a compound of formula I.

The phosphated mild steel may be treated with the compound of formula I by any suitable method of contacting a metal surface with a solution of the compound of formula I, for instance by immersion of the metal in the solution or painting or spraying on to the metal surface.

The compounds of formula I have been found to seal the phosphate coating on phosphated mild steel.

The present invention also provides phosphated mild steel which has been treated with a compound of formula I.

The compounds of the present invention may be used in food preservation, in constructional formulations for the control of setting times of plaster or cement or for use in cutting fluids or other aqueous systems where scale inhibition or corrosion inhibition exists. They may also be used in oil systems, for example as sulphur scavengers and extreme pressure additives.

The following Examples 1 to 11 further illustrate the present invention.

EXAMPLE 1

Reaction of benzylidene methylamine with sulphur dioxide

Benzylidene methylamine 17.85 parts (0.15 mole) is charged to a reaction vessel and dissolved in 150 parts dry ethanol to which is added 2.7 parts (0.15 mole) water. The reaction vessel is cooled with ice-water during the passage of sulphur dioxide gas so that the temperature of the reactants remains below 40° C. After 10 minutes a white solid precipitates and this is filtered, washed with ethanol and dried.

Yield 23.4 parts, m.p. 136°-9° C

Found: C, 47.8; H, 5.9; N, 7.0; S, 15.9 percent. Calculated for structure II: C, 47.8; H, 5.5; N, 7.8; S, 15.7 percent $R^2 = C_6H_5$, $R^1 = CH_3$).

Structure II confirmed by $^1H$ n.m.r. and $^{13}C$ n.m.r..

The percentage yield, melting point and structure is given in Table 1.

EXAMPLE 2

Reaction of benzylidene ethylamine with sulphur dioxide

Benzaldehyde (106 parts) is charged to a reaction vessel and dissolved in 410 parts ethanol. A 33 percent solution of ethylamine (135 parts) in ethanol is then added to the cooled solution at 5°-10° C with stirring. Sulphur dioxide gas is then passed through the solution and the temperature kept below 40°.

A white solid precipitated and this is washed with cold ethanol and dried.

Yield of solid, 206 parts (95.8 percent) m.p. 87°-89° C

Found: C, 50.35; H, 7.0; N, 5.3; S, 12.6 percent. Calculated for product of structure IV with 1 mol. ethanol of: C, 50.6; H, 7.3; N, 5.4; S, 12.3 percent.

crystallisation Structure confirmed by $^1H$ n.m.r. and $^{13}C$ n.m.r.

The percentage yield, melting point and structure is given in Table 1.

EXAMPLES 3 TO 11

By following a similar procedure to that described in Example 1 but using a Schiff's base with $R^1$ and $R^2$ as defined in Table 1, compounds of the present invention are produced in which the percentage yields, melting points and structures are given in Table 1. The structures were assigned from $^1H$, $^{13}C$ n.m.r. and infrared spectroscopy and confirmed by elemental analyses.

TABLE 1

| Example | $R^2$ | $R^1$ | Yield (%) | Melting point ° C | Structure |
|---|---|---|---|---|---|
| 1 | $C_6H_5$ | $CH_3$ | 74 | 136-9 | II |
| 2 | $C_6H_5$ | $C_2H_5$ | 79 | 87-89 | II |
| 3 | $C_6H_5$ | $C_6H_{11}$ | 92 | 136-40 | IV |
| 4 | $C_6H_5$ | $C_{12}H_{25}$ | 63 | 95-98 | III |
| 5 | $C_6H_5$ | $C_{18}H_{37}$ | 80 | 80-82 | II |
| 6 | 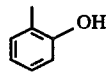 | iso-$C_4H_9$ | 35 | 158-9 | II |
| 7 | 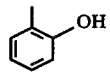 | $CH_3$ | 87 | 82-4 | II |
| 8 | 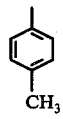 | $CH_3$ | 55 | 120-4 | II |
| 9 | 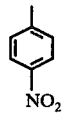 | $CH_3$ | 91 | 128-132 | III |
| 10 | 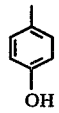 | $CH_3$ | 76 | 132-141 | II |
| 11 | 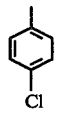 | $CH_3$ | 71 | 120-123 | II |
| 12 | $C_6H_5$ | $CH_2{=}CHCH_2$ | 77 | 94-96 | II |

COMPARATIVE EXAMPLE A

Reaction of benzylidene aniline with sulphur dioxide

Benzylidene aniline (37.4 parts 0.2 mole) is charged to a flask and dissolved in 250 parts ethanol containing 5.5 parts (0.3 mole) water. Sulphur dioxide gas is bubbled through the stirred solution and the flask is kept cool with ice to a temperature of 20°-25° C. After a few minutes the product precipitates and precipitation is complete after a further ten minutes.

The product is then filtered and washed with ethanol.

Yield 34.6 parts (64.3 percent); m.p. 129°-130° C

Found: C, 64.0; H, 5.7; N, 7.9; S, 9.0 percent Calculated for structure IV: C, 64.1; H, 5.6; N, 7.9; S, 9.0 percent ($R' = C_6H_5$; $R^2 = C_6H_5$)

Structure IV confirmed by $^1H$ n.m.r. and $^{13}C$ n.m.r.

COMPARATIVE EXAMPLE B

Reaction of sodium metabisulphite with benzaldehyde

To a 40 percent aqueous solution of sodium metabisulphite was added benzaldehyde dropwise. After cooling a white solid precipitated. This was filtered, washed with ethanol and dried to yield the sodium bisulphite derivative of benzaldehyde.

Structure confirmed by $^1H$ n.m.r. and $^{13}C$ n.m.r.

EXAMPLES 13 AND 14

Painted panels of zinc phosphate coated mild steel in Example 13 and ferric phosphate coated mild steel in Example 14 were prepared in the following manner:

1 Excess oil was wiped from a three inch by two inch, 20 S.W.G. "fully finished" test panel with absorbent tissue.

The panel was then successively:

2 Degreased in an acetone bath for approximately 5 minutes.

3 Air dried.

4 Immersed in the following alkali cleaning bath:

Sodium hydroxide — 37.5 grams per liter
Sodium carbonate — 25.0 grams per liter
Trisodium phosphate ($12H_2O$) — 6.2 grams per liter
Teepol — 1.5 grams per liter at 80°-90° C for approximately five minutes.

5 Water rinsed for at least 30 seconds.

A steady flow of tap water through the rinse bath was maintained to ensure that the phosphating bath did not become contaminated with alkali.

6 Phosphated in a 'Bonderite 75' bath (a zinc phosphating bath) for 5 minutes at 70° C to produce a zinc phosphated mild steel or for two minutes at 70° C in a 'Bonderite 100' bath (a ferric phosphating bath) to produce a ferric phosphated mild steel. The baths were prepared according to the supplier's recommendations.

7 Rinsed for 30 seconds.

8 Immersed in 0.025 percent weight/volume solution of the solubilised test compound for one minute at 70° C. Sufficient alkali is added to just solubilise the test compound giving a solution usually within the pH range 3 to 10.

9 Rinsed for 15 to 30 seconds.

10 Oven dried.

11 The panel was then painted by dipping into a bath of 'Synthetic Stoving Cream Enamel', Reference RD 33321, supplied by A. Holden and Son. The panel was removed, allowed to drain and stoved in an oven at 140° C for 20 minutes. Before using the paint, blank panels were painted and the film thickness measured using an Elcometer film thickness gauge. A film thickness of 1.25 thousandths of an inch (± 0.25) was obtained by adjusting the viscosity of the paint with a 2:1 mixture of 2-ethoxy ethanol:n-butanol.

After preparation the panels were allowed to stand for 24 hours. Diagonals were then scored across the panels so that the paint film was broken. The panels were then subjected to continuous salt spray test according to ASTM B117.

Assessment of result

In Example 12 the panel of zinc phosphate coated mild steel was examined for corrosion and after eight days the undercutting of the score mark on the paint surface of the zinc phosphated panel using the compounds of Examples 1 and 2 was 1.0 millimeter in each case.

By comparison the undercutting of the score mark on the paint surface after eight days of the zinc phosphated panel without an additive was 2.5 millimeters.

In Example 13 the panel of ferric phosphate coated mild steel was examined for paint film adhesion by the following manner:

After the salt spray test the panel was washed and dried with a tea towel. The paint film adhesion was then estimated by firmly applying a strip of one inch wide "SELLOTAPE" along one of the diagonals and then stripping it off.

The percentage of surface area of paint film remaining where the "SELLOTAPE" had been applied was used as a criterion of paint film adhesion.

The percentage adhesion after 14 days using the compound of Examples 1 and 2 was 90 percent whereas the percentage adhesion after 14 days without an additive was only 30 percent.

The comparative Examples A and B when used at the same concentration as Examples 1 and 2 of the invention gave the same level of adhesion as the test panel in which no additive was added, that is 30 percent. The Examples A and B fall outside those of the invention.

What we claim is:

1. A compound having the general formula

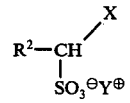

wherein X is OH or $NHR^1$, Y is hydrogen or $NH_3R^1$, with the proviso that when X is OH Y cannot be hydrogen, $R^1$ is a saturated or unsaturated aliphatic or cycloaliphatic hydrocarbon radical containing from 1 to 20 carbon atoms optionally substituted by one or more halogen, cyano, nitro, hydroxyl, carboxyalkyl or sulphoxyalkyl radicals in which the alkyl group contains from 1 to 4 carbon atoms, and $R^2$ is an aryl, alkaryl or aralkyl radical containing from 6 to 20 carbon atoms which may be optionally substituted by one or more cyano, nitro, halogen, hydroxyl, carboxyl, carboxymethyl, carboxyethyl, hydroxymethyl or methoxymethyl radicals or mixtures thereof.

2. A compound as claimed in claim 1 in which $R^1$ is a saturated or unsaturated aliphatic hydrocarbon radical containing from 1 to 10 carbon atoms.

3. A compound as claimed in claim 2 in which $R^1$ is a saturated or unsaturated aliphatic hydrocarbon radical containing from 1 to 4 carbon atoms.

4. A compound as claimed in claim 1 in which $R^2$ contains from 6 to 10 carbon atoms.

5. A compound as claimed in claim 1 in which $R^2$ is a phenyl residue.

6. A compound as claimed in claim 1 in which $R^1$ is methyl or ethyl and $R^2$ is phenyl.

7. A method of treating phosphated mild steel or zinc coated mild steel which comprises contacting the mild steel with a solution containing a compound of formula I

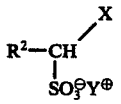

I wherein

X is OH or $NHR^1$, Y is hydrogen or $NH_3R^1$, with the proviso that when X is OH, Y cannot be hydrogen, $R^1$ is a saturated or unsaturated aliphatic or cycloaliphatic hydrocarbon radical containing from 1 to 20 carbon atoms optionally substituted by one or more halogen, cyano, nitro, hydroxyl, carboxyalkyl or sulphoxyalkyl radicals in which the alkyl group contains from 1 to 4 carbon atoms, and $R^2$ is an aryl, alkaryl or aralkyl radical containing from 6 to 20 carbon atoms which may be optionally substituted by one or more cyano, nitro, halogen, hydroxyl, carboxyl, carboxymethyl, carboxyethyl, hydroxymethyl or methoxymethyl radicals or mixtures thereof.

8. A method as claimed in claim 7 in which the metal is immersed in the solution of the compound of formula I.

9. A method as claimed in claim 7 in which the solution of the compound of formula I is painted on to the metal surface.

10. A phosphated mild steel treated with a compound of formula I by the method of claim 7.

* * * * *